US005207374A

United States Patent [19]

Lo Duca

[11] Patent Number: 5,207,374

[45] Date of Patent: May 4, 1993

[54] BOX WITH A BREAKABLE SEAL WHICH IS BROKEN AS THE BOX IS OPENED

[75] Inventor: Carmelo Lo Duca, Milan, Italy

[73] Assignee: GI.BI.EFFE S.r.L., Milan, Italy

[21] Appl. No.: 900,730

[22] Filed: Jun. 18, 1992

[30] Foreign Application Priority Data

Jun. 21, 1991 [IT] Italy ..... 001708 A/91

[51] Int. Cl.[5] ..... B65D 5/42; B65D 5/54

[52] U.S. Cl. ..... 229/102; 206/807; 229/148; 229/153

[58] Field of Search ..... 229/102, 148, 149, 150, 229/151, 152, 153; 206/807

[56] References Cited

U.S. PATENT DOCUMENTS

| | | | |
|---|---|---|---|
| 598,087 | 2/1898 | Harker | 229/102 |
| 636,806 | 11/1899 | Johnstone | 229/148 |
| 2,116,652 | 5/1938 | Adler | 229/102 |
| 3,233,818 | 2/1966 | Bixler et al. | 229/102 |
| 4,063,678 | 12/1977 | Hall | 229/102 |
| 4,163,492 | 8/1979 | Rella | 229/150 |
| 4,746,052 | 5/1988 | Schmissrauter . | |
| 4,830,270 | 5/1989 | Holmes | 229/150 |
| 4,890,789 | 1/1990 | Lo Duca | 229/102 |
| 4,917,288 | 4/1990 | Heitele et al. | 229/102 |

FOREIGN PATENT DOCUMENTS

| | | | |
|---|---|---|---|
| 0318750 | 6/1989 | European Pat. Off. . | |
| 3826231 | 2/1990 | Fed. Rep. of Germany | 229/148 |
| 2504892 | 11/1982 | France | 229/148 |
| 289127 | 4/1928 | United Kingdom | 229/153 |

*Primary Examiner*—Gary E. Elkins

*Attorney, Agent, or Firm*—Oblon, Spivak, McClelland, Maier & Neustadt

[57] ABSTRACT

A box includes one or more cover elements having a closure panel from which a tongue extends. The tongue can be introduced into the box as the cover is closed and through the tongue an elongated window is provided, at and near which a hole is formed through the cover closure panel. Under the cover closure panel there are provided flaps which project from one or more main panels of the box. The flaps being folded and arranged under the closure panel as the related cover is closed. From at least one of the flaps there extends a hook shaped tooth which projects in the window and is locked therein. The tooth being separated by its respective flaps by way of a preset breakage line, so that the tooth operates as a seal element and is torn from the flap as the cover is opened. The presence of the tooth and accordingly the untampered condition of the box can be checked through the hole formed through the closure panel.

5 Claims, 2 Drawing Sheets

BOX WITH A BREAKABLE SEAL WHICH IS BROKEN AS THE BOX IS OPENED

BACKGROUND OF THE INVENTION

1. Field of the Invention

The present invention relates to a box provided with a breakable seal which is broken as the box is opened and, more specificablly, a box of the type including one or more closure covers against which latching teeth projecting from the underlaying flaps of each cover interfere in order to remarkably increase the resistance against opening of the box.

2. Discussion of the Related Art

In the U.S. Pat. No. 4,890,789 patent corresponding to the European EP-B-0318750 patent and moreover in the German Patent Application DE-A-3826231 there are disclosed boxes provided with covers (in general only the bottom cover of each box) having a high resistance against opening. The cover intended for presenting a high resistance against opening is provided with a folded tongue which can be introduced into the inside of the box, laterally of one or more flaps projecting from some main panels of the box and just arranged under the related cover (this construction being a conventional construction for all of the like type boxes). The box is characterized in that through the tongue there is formed a thin elongated window or slit therein engage (with the box being closed) hook or dovetail shape teeth which project from the mentioned tongues.

As a pulling force is exerted on the cover, in order to open it, the mentioned teeth are raised away from their rest positions, since these teeth are rigid with the tongues which in turn are connected to the adjoining main panels of the box along slanted folding lines (in general perpendicular) with respect to the folding line thereabout the cover can turn. The raising movement of the teeth (under the pulling force exerted thereon by the cover to be opened) causes the teeth to spread apart with respect to the window in which they are engaged, so as to strongly engage with the tongue therethrough the window or slit is provided.

Thus, the resistance against opening of the box cover is greatly increased by the restraining force exerted thereon by the teeth projecting from the box flaps.

However, by suitable operations, one can still open the box cover or covers and then reclose them without having trace of a previous opening thereof.

SUMMARY OF THE INVENTION

Accordingly, the main object of the present invention is to provide a box of the above mentioned type which is so improved as to allow a person to easily and quickly establish if the box has been previously opened. This would include a warranty seal adapted to be broken as the cover is at first opened, thereby the presence and untampered condition of the box can be easily checked.

This and yet other objects are achieved by a box comprising at least three adjoining main panels defining a box body and separated from one another by folding lines formed on a die cut flexible material sheet, and at least a closure cover for the box. The cover including a tongue projecting from a closure panel in turn projecting from one of the main panels. The closure panel being separated from the tongue and from the main panel by folding lines. The tongue being adapted to be introduced into the box under at least one of the other main panels, and through the tongue there being provided at least an elongated window defined by a substantially C-shape cut made through the tongue. A central portion of the C-shape cut being substantially parallel to a folding line separating the tongue from an adjoining closure panel and the cut having two end portions which are slanted with respect to the central portion thereof and extend at least up to an adjoining folding line in order to define a lug projecting from the closure panel and coplanar therewith. A rotary flap projecting from at least one of the other main panels and being provided for turning about a folding line and adapted to be arranged under the closure panel of the cover. A hook shaped tooth projecting from the flap and having a side thereof facing a folding line between the flap and the main panel from which the flap projects being slanted so that the tooth has a largest width at a free end portion thereof with the largest width of the tooth being smaller than a length extension of the window therein the tooth is extended and therefrom the tooth projects as the cover is closed, wherein at least a hole is formed through said lug of said closure panel. The hole being arranged above the tooth as the cover is closed and wherein on the flap there is formed a preferential preset breakage line for facilitating a separation of the tooth from the flap.

Preferably, the surface of the tooth which can be seen through the hole of the lug is so marked as to clearly show a portion of the flap as the box cover is closed.

The box according to the present invention is made starting from a single piece sheet of a die cut flexible material comprising at least three adjoining main panels and a box clamping strip projecting from one of said panels. The clamping strip and panels being separated from one another by folding lines, on a same side as the main panels projecting at least a flap and a closure panel therefrom a tongue extends. The flap and closure panel being separated from their respective main panels therefrom said flap and closure panel extend by slanted folding lines which are slanted with respect to folding lines separating from one another the main panels. The closure panel being also separated by its respective tongue by a folding line, through the tongue there being formed at least a substantially C-shaped cut having a central portion which is substantially parallel to a folding line between the tongue and closure panel and having two end portions being slanted with respect to the central portion and extending at least to an adjoining folding line so as to define a lug projecting from the closure panel and coplanar therewith, from at least one of the tongue a hook tooth projecting, the hook tooth having a side thereof facing a folding line separating the tongue from the main panel therefrom the tongue projects. The side being so slanted that the tooth has a largest width at a free end portion thereof. The largest width of the tooth being less than a length extension of the central portion of the cut formed through the tongue, wherein the tooth is separated by a remaining portion of said tongue by a preset preferential breakage line, and wherein through the closure panel lug there is formed a hole allowing the tooth to be seen with the box made from the sheet being closed.

BRIEF DESCRIPTION OF THE DRAWINGS

In order to provide a better understanding of the construction and features of the breakable seal box according to the invention, two embodiments thereof will be hereinafter disclosed, by way of an indicative but not limitative example, with reference to the accompanying drawings, where.

DESCRIPTION OF THE PREFERRED EMBODIMENTS

Figure 1:
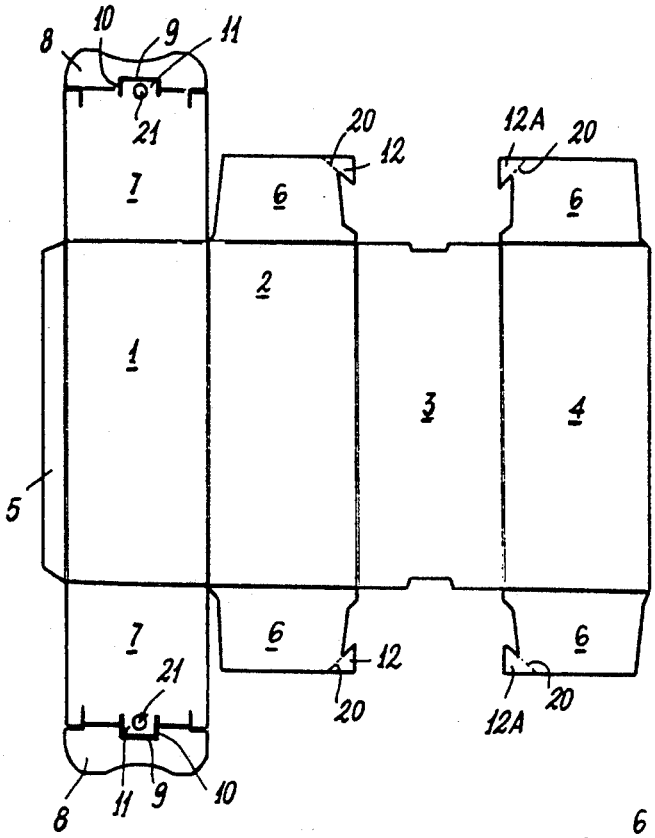
FIG. 1 is a front view of a die-cut paperboard sheet which has been properly cut for making the box according to the invention.
Figure 2:
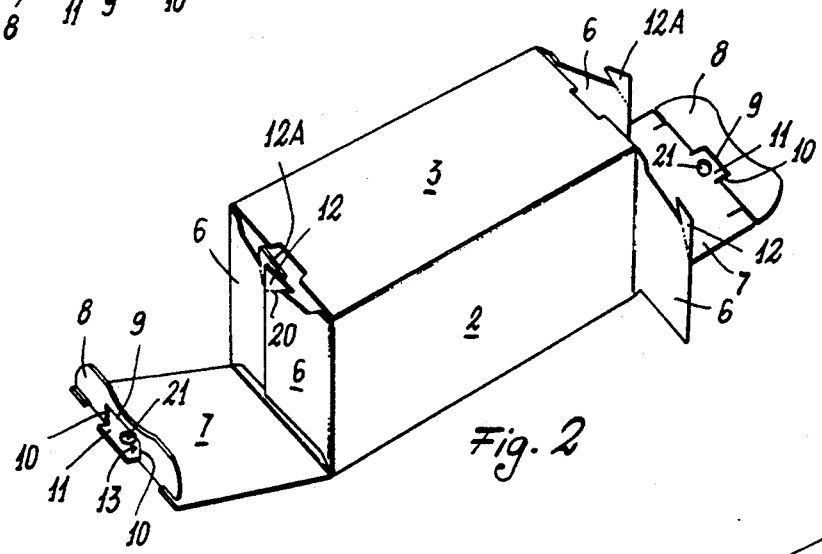
FIGS. 2 and 3 are perspective views of a box made from the sheet of FIG. 1, the two box covers being shown in their fully open and respectively closed conditions.

With reference at first to FIG. 1, a die-cut and cut paperboard sheet is herein shown which comprises four main panels 1, 2, 3 and 4 and a clamping strip 5, which are arranged with an adjoining relationship and being separated from one another by parallel folding lines. Die-cut and cut relates to the concept of cutting a cardboard piece along its periphery and along certain lines and providing the same cardboard piece with folding lines along other lines. From each end of the panels 2 and 4 a flap 6 projects. Also, from each end of the panel 1 a closure panel 7 projects, from which a tongue 8 extends. The flaps 6 and panels 7 being separated from their respective main panels by folding lines which are perpendicular to the folding lines separating from one another the main panels. The tongue 8 being separated from the closure panels 7 from which they project by folding lines which are also perpendicular to the folding lines existing between the main panels.

Through each tongue 8 there is formed a C-shaped cut having a central portion 9 which is parallel to the folding line between the tongue 8 and the adjoining panel 7, and further having two end portions 10 which are perpendicular to the folding line and extend beyond the folding line, so as to reach by a short portion the panel 7. The C-shaped cut defining a lug 11 which projects from the panel 7 such that the lug is and remains coplanar in the box made from the herein disclosed paperboard sheet.

In the embodiment shown in FIGS. 1 to 5, from each flap 6 a hook shaped tooth 12, 12A projects. Each of the hook shaped teeth 12, 12A having a side which faces the folding line separating the flap from the main panel from which the flap extends which is slanted so that the tooth 12, 12A has the its largest width at its free end portion, as is clearly shown in FIG. 1.

In order to make the box, the clamping strip 5 is glued inside the main panel 4 (at the free edge thereof), then the flaps 6 projecting from the same end portion of the box (FIG. 2) are folded on to one another, so that the two teeth 12, 12A projecting from the pair of flaps 6 arranged on the same side of the box will have their outer free edges precisely superimposed onto one another. Since the maximum width of the teeth 12, 12A is slightly less then the length of the central portion 9 of the cut through the tongue 8, as this tongue is folded with respect to the closure panel (as shown at the left end portion of the box of FIG. 2), through the tongue 8 there is automatically formed (because of the folding of the tongue with respect to the panel 7) an elongated window 13 therein. The window 13 will automatically engage the pair of teeth 12, 12A as the cover is closed and as the tongue 8 is caused to enter the box, by causing it to contact the inner surface of the main panel 3: simultaneously, the closure panel 7 will be brought into contact on the outer surfaces of the adjoining tongues 6 (which are partially superimposed onto one another).

Figure 3:
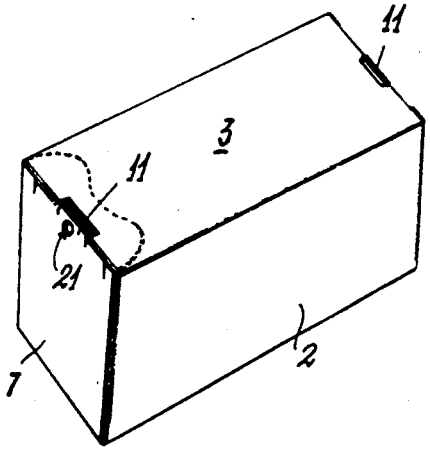
Figure 4:
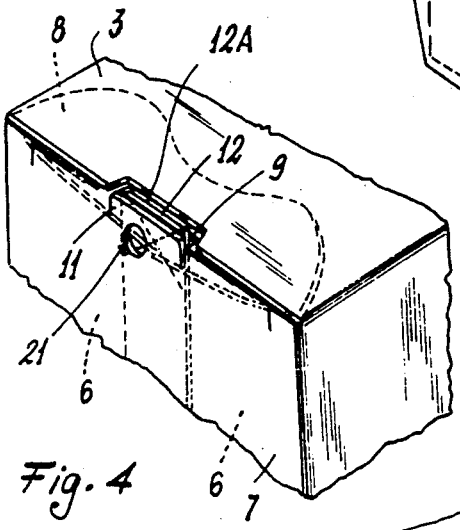
FIG. 4 is a partial perspective view, on an enlarged scale, of the left end portion of the box shown in FIG. 3.

FIG. 3 shows the box in its fully closed condition, the left end portion of the box being reproduced on an enlarged scale in FIG. 4, which latter shows that the lug 11 is superimposed onto the two teeth 12, 12A extending through the window 13 so as to slightly project from the outer surface of the tongue 8.

The closure panel 7 and its related tongue 8 form that element which is herein called closure "cover" for the box.

Figure 5:
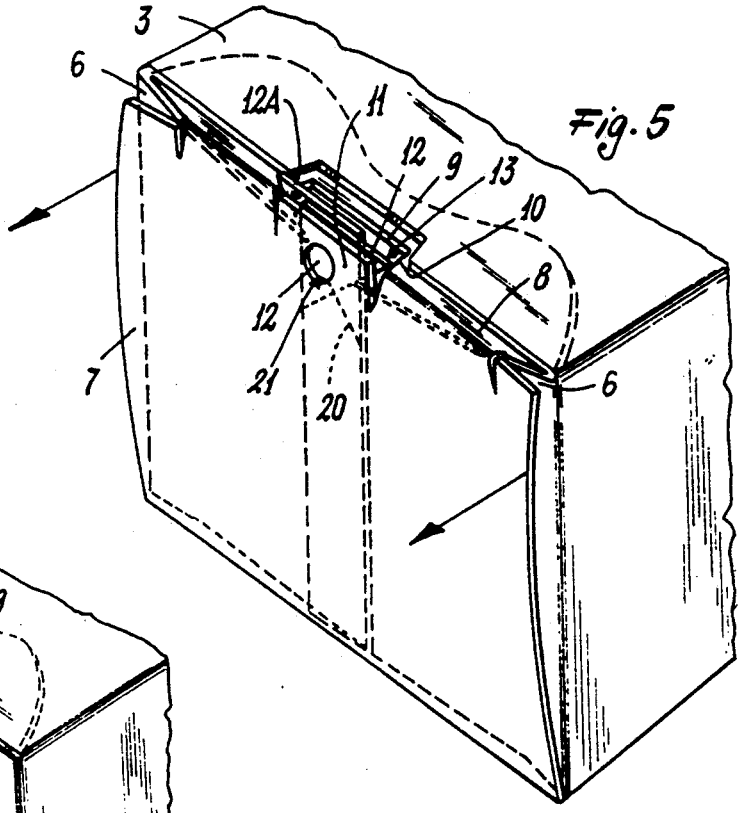
FIG. 5 is a perspective view, on a further enlarged scale, of the same box portion shown in FIG. 4, but illustrated in a first opening step of the cover.

In order to open the box, it is necessary to grip the closure panel 7 (see the enlarged detail of FIG. 5) and pull the closure panel in the direction indicated by the arrows herein shown. This will cause the edge of the panel 7 where the lug 11 is formed to be raised away from the adjoining main panel 3 of the box, and also the teeth 12 will be raised in the same raising direction, since these teeth are pressed by the central portion 9 of the edge of the window 13 formed through the tongue 8. In FIG. 5 this central portion 9 of the window edge has been shown spaced from the adjoining tooth 12A exclusively in order to allow an easy understanding of the operation and action of the teeth: actually as the closure panel 7 is raised in the direction of the arrows (FIG. 5), the central portion 9 of the window 13 will abut on the tooth 12A so as to affect tooth 12A.

However, since the flap 6 from which the teeth 12, 12A project can exclusively turn about the folding lines separating them from the respective main panels 2 and 4, as the pair of teeth 12, 12A are raised, they will be spread apart. This will cause the tooth 12A to be leftwardly displaced (with respect to the window 13) since the tooth 12A is rigid with the flap 6 shown at the left portion of FIG. 5, and will cause the tooth 12 which is rigid with the flaps shown on the right portion of this figure to be rightwardly displaced. Accordingly, the points of these two teeth will be spread apart from one another, so that the slanted edges of the two teeth will engage the edges 10 of the window 13, as it is clearly shown in FIG. 5.

Thus, the teeth 12 and 12A will provide a remarkable resistance against opening of the box cover.

The construction and features of the box which have been hereinabove disclosed are fully analogous to those shown in the U.S. Pat. No. 4,890,789 document and in its corresponding European patent EP-B-0318750.

With the disclosed construction, the cover of the box can be opened and then reclosed, even with some difficulties.

The object of the present invention, as stated, is that of providing a warranty seal allowing, by a simple visual inspection of the closed box, to establish if the box has been previously opened (for example in order to tamper with its contents).

To that end, one of or both the teeth 12, 12A projecting from the flaps 6 provided at each end of the box is/are separated from the remaining portion of the respective flaps by means of a preset preferential breakage line 20. This is made by, for example, knurling the box forming paperboard, but is preferably made by making a continuous incision along the line, formed on the surface of the paperboard material, and provided for facing outwardly from the box. The incision having, for example, a depth corresponding to about a half of the paperboard thickness. Thus, as the cover of the box is urged in order to be opened for the first time, the tooth or teeth at which the above mentioned preferential breakage line has been formed, will be torn away from the respective flaps. The teeth, however, will still provide a great mechanical resistance against the opening of the bottom of the box as they are exclusively urged by the weight of an article held in the box.

Moreover, as shown, through the lug 11 a hole 21 is formed which is precisely superimposed on the teeth 12 with the box being closed. Through this hole 21 it is possible to clearly see the immediately underlaying tooth 12, 12A, the presence of which can be established in a further improved way by coloring the tooth (for example in red) with a color contrasting that of the lug 1.

As the box is opened, one of or both the teeth 12, 12A will be torn away. If the box is reclosed, then it is very easy to immediately establish if the breakable restraining tooth or teeth are still present or if they are lacking (so as to demonstrate, in the latter case, that the box has been already opened).

Preferably, the same warranty seal closure system is provided at the two end portions of the box: in particular, one of the covers cold be permanently closed, for example by glueing it.

Also preferably, exclusively one of the two teeth arranged under each cover (and precisely that tooth which can be directly seen through the hole 21) is provided with a preset breakage portion for removing it from its respective flap.

Figure 6:
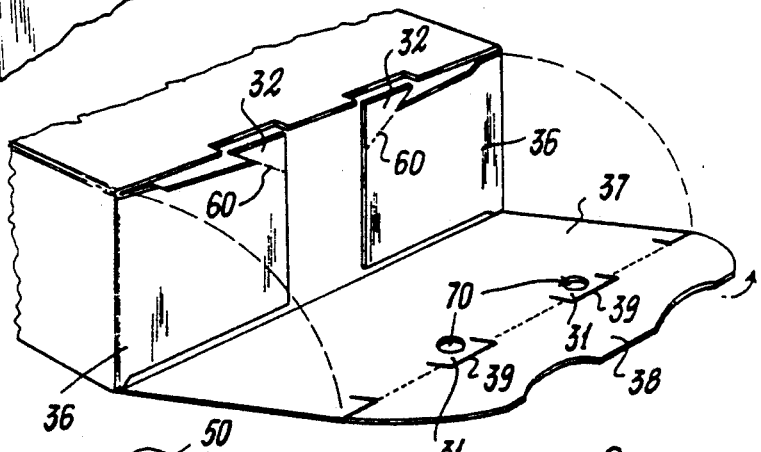
FIGS. 6 and 7 are perspective views of an end portion of a modified embodiment of the box, with the cover thereof in a fully open condition before its closure, and respectively with the cover shown in a closed condition.
Figure 7:
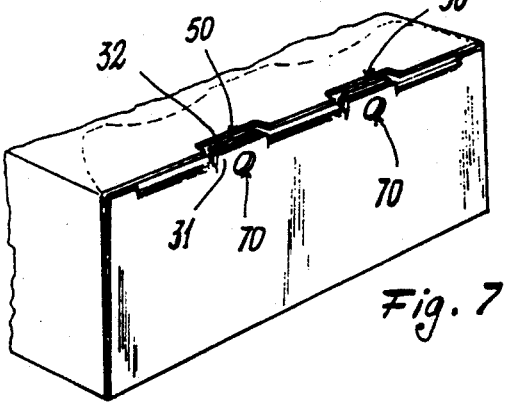

FIGS. 6 and 7 show an end portion of a modified box embodiment (which is analogous to that of the German patent DE-A-3826231) in which the two flaps provided are each end of the box are spaced from one another with each flap being provided with a projecting tooth analogous to the above disclosed teeth. In this connection it should be apparent that the two teeth should not superimpose onto one another as the cover is closed and, to that end, through the tongue 38 projecting from the closure panel 37 there are formed two discrete C-shape cut outs 39 defining two discrete lugs 31 coplanar with the panel 37 (FIG. 6).

As the tongue 38 is folded with respect to the panel 37, two discrete windows 51 will be formed, and each of the latter will firmly engage therein one of the clamping or restraining teeth 32.

Likewise, at least one of the two teeth 30 will be separated from the remaining portion of the flaps 36 from which it projects, by means of preset breaking line 60. Through each lug 31 a hole 70 will be formed allowing a user to easily establish if the underlaying tooth is present, that is if the box has been already opened.

What is claimed as new and desired to be secured by Letters Patent of the United States is:

1. A box comprising:

at least three adjoining main panels defining a box body and separated from each other by first folding lines formed on a die cut flexible material sheet;

at least one closure panel for said box, said closure panel projecting from one of said main panels and including a tongue which projects from said closure panel, said closure panel being separated from said tongue and from said one main panel by second folding lines, such that said tongue can be introduced into said box under at least a second one of said main panels;

at least one elongated window provided through said tongue, said elongated window being defined by a substantially C-shaped cut made through said tongue, a central proton of said C-shaped cut being substantially parallel to one of said second folding lines which separates said tongue from said closure panel, said cut having two end portions which are slanted with respect to said central potion thereof and extend at least up to said one of said second folding lines for defining a lug projecting from said closure panel and coplanar therewith;

at least one rotary flap projecting from at least a third one of said main panels, said rotary flap being adapted to turn about a third folding line which is between said flap and said third one of said main panels and being further adapted to be arranged under said closure panel; and at least one hook shaped tooth projecting from said flap, said hook shaped tooth having a side which faces said third folding line and is slanted such that said tooth has a free end portion with a largest width, said largest width of said tooth being smaller than a length of said window for permitting the tooth to extend through and project from said window when said closure panel is closed;

wherein:

at least a hole is formed though said lug of said closure panel, said hole being arranged above said tooth when said closure panel is closed; and a preset breakage line is formed on said flap for facilitating a separation of said tooth from said flap.

2. The box according to claim 1, wherein said hooked shaped tooth which can be seen through the hole of said lug is marked to make the tooth clearly visible when the closure panel of the box is closed.

3. The box according to claim 1, comprising two rotary flaps each of which project from each said of said at least third one of said main panels, each of said rotary flaps being adapted to be partially superimposed onto one another under said third one of said main panels, each of said flaps comprising one of said hook shaped teeth, such that when the box is in a closed condition, each of said teeth are superimposed on one another with both teeth extending through said window, said preset breakage line being provided for at least one of said teeth.

4. The box according to claim 1, comprising two rotary flaps each of which projects one of said hooked shaped teeth which are spaced from one another when the box is closed, said closure panel comprising two elongated windows which are spaced from one another for permitting each of said hook shaped teeth to extend through each of said elongated windows, said preset breakage line being formed on at least one of said flaps and being arranged between said one flap and the respective tooth wherein said hole formed on the lug of the at least on closure panel is superimposed on said at least one tooth having the present breakage line.

5. A flexible material die-cut and cut single piece sheet for making a box with a breakage seal, comprising:

a single piece sheet having at least three adjoining main panels and a box clamping strip projecting from one of said panels, said clamping strip and panels being separated from one another by first folding lines;

at least one flap and at least one closure panel projecting from the same side of said main panels, wherein a tongue extends from the closure panel, said flap and closure panel being separated from the respective main panels from which said flap and closure panel extend by second folding lines which are slanted with respect to the first folding lines separating the main panels from each other, said closure panel being also separated from said tongue by a third folding line;

at least one substantially C-shape cut being formed though said tongue, said C-shaped cut having a central portion which is substantially parallel to the third folding line between said tongue and closure panel and having two end portions being slanted with respect to said central portion and extending at least to the third folding line so as to define a lug projecting from said closure panel and coplanar therewith; and at least one hook tooth projecting from said panel, said hook tooth having a side thereof facing one of said second folding lines separating the flap from the main panel, said side being so slanted that said tooth has a largest width at a free end portion of the tooth thereof, said largest width of said tooth being less than length of said central portion of said cut formed through said tongue, wherein said tooth is separated from said flap by a preset breakage line, and wherein through said lug there is formed a hole allowing said tooth to be seen when the box made from said sheet is closed.

* * * * *